United States Patent [19]

Bogdanov et al.

[11] Patent Number: 4,949,907

[45] Date of Patent: Aug. 21, 1990

[54] BALL-TUBE MILL

[75] Inventors: Vasily S. Bogdanov; Nikolai S. Bogdanov; Nikolai D. Vorobiev, all of Belgorod; Alexandr D. Netesin, Stary Oskol, all of U.S.S.R.

[73] Assignee: Belgorosky Tekhnologichesky Institut, Stroitelnykh Material OV Imeni, I.A. Grishmanova, Belgorod, U.S.S.R.

[21] Appl. No.: 403,597

[22] Filed: Sep. 6, 1989

Related U.S. Application Data

[63] Continuation of Ser. No. 184,284, Apr. 21, 1988, abandoned.

[51] Int. Cl.[5] ..... B02C 17/06

[52] U.S. Cl. ..... 241/70; 241/76; 241/78; 241/153; 241/171; 241/176

[58] Field of Search ..... 241/70, 71, 72, 76, 241/78, 79, 79.2, 153, 170, 171, 172, 176, 179, 182

[56] References Cited

U.S. PATENT DOCUMENTS

| | | | |
|---|---|---|---|
| 983,069 | 1/1911 | Lindhard | 241/70 |
| 1,279,335 | 9/1918 | Hardinge | 241/70 |
| 1,683,627 | 9/1928 | Read | 241/72 |
| 2,931,583 | 4/1960 | Johnson | 241/70 |
| 3,964,717 | 6/1976 | Hansen | 241/70 X |

FOREIGN PATENT DOCUMENTS 961761 9/1982 U.S.S.R. .

*Primary Examiner*—Joseph M. Gorski
*Attorney, Agent, or Firm*—Lilling and Lilling

[57] ABSTRACT

A ball-tube mill in which an inclined wall dividing the mill into coarse and fine grinding chambers occupied by grinding bodies has through holes for the passage of the material being ground provided in a portion of contact of the surface of the inclined wall with the grinding bodies present in the coarse grinding chamber. The through holes have a length much greater than their width with their elongated side running in parallel with an outer contour of the inclined wall.

4 Claims, 3 Drawing Sheets

BALL-TUBE MILL

This is a continuation of copending application Ser. No. 184,284 filed on 4/21/88 now abandoned.

BACKGROUND OF THE INVENTION

1. Field of the Invention

This invention relates generally to the art of comminuting materials, and more particularly to ball-tube mills.

2. Description of the Prior Art

There is known a ball-tube mill comprising a cylindrical housing having in the interior thereof an inclined partition or wall in the form of an ellipse separating the cylindrical housing into coarse and fine grinding chambers occupied by grinding bodies.

The housing of the ball-tube mill is enclosed at the ends by bottoms, journalled in bearings, and kinematically linked with a drive for rotating it around its longitudinnal centerline. The inclined wall has holes provided in the portion of contact of its surface with the grinding bodies present in the coarse grinding chamber. These holes are arranged in parallel with each other and extend along the minor elliptical axis of the inclined wall (cf., e.g., USSR Inventor's Certificate No. 961,761, published in Bulletin "Discoveries,Inventions,Industrial Designs, Trademarks" No. 36, Sept. 30, 1982).

The width of the holes in such an arrangement is insufficient for the passage of the particles of material being ground through the inclined wall, whereby they return to the coarse grinding chamber to result in reduced throughput capacity of the wall, and consequently in less efficient operation of the ball-tube mill.

The object of the present invention is to increase the throughput capacity of a ball-tube mill.

SUMMARY OF THE INVENTION

The objects of the invention are attained by a ball-tube mill in which an inclined wall dividing a lined drum into coarse and fine grinding chambers occupied by grinding bodies has through holes for the passage of the material to be ground, these holes being provided in the portion of contact of the surface of the inclined wall with the grinding bodies present in the coarse grinding chamber. According to the invention, the through holes have a length substantially greater than their width, while their longer sides extend in parallel with an outer contour of the inclined wall.

Preferably, the length of each through hole is at least 25 times its width.

Such a length of the holes ensures favourable conditions for the passage of the material being ground through the inclined wall at the optimum rate of rotation of the mill drum equal to 0.6–0.8 of the critical rate of rotation.

Advisably, the shorter sides of the through holes of the inclined wall are beveled toward the fine grinding chamber.

This arrangement facilitates the passage of the particles of the material being ground through the holes in the inclined wall and promotes a longer service life of the inclined wall.

Desirably, the through holes flare toward the fine grinding chamber, for which purpose the side of the through hole adjacent the outer contour of the inclined wall forms with a plane perpendicular to the plane of the inclined wall an angle equal to the angle of inclination of this wall to a longitudinal centerline of the ball-tube mill.

Such through holes facilitate the passage of the material being ground through the inclined wall, and obviate clogging of these with broken particles of the grinding bodies.

Alternatively, provided in a portion of the inclined wall, which is not in contact with the grinding bodies, are through holes a longer side of each of which is parallel with the minor axis of the inclined wall, their axes of symmetry being parallel with the longitudinal centerline of the ball-tube mill.

Such an arrangement of holes at the remaining protion of the inclined wall minimizes its hydraulic resistance and prevents back-spill of the ground material from the fine grinding chamber to the coarse grinding chamber.

In view of the aforedescribed, the ball-tube mill according to the present invention provides maximum throughput of the material being ground through the inclined wall, minimizes back-spill of the material from the fine grinding chamber to the coarse grinding chamber, and features low hydraulic resistance, which in turn makes it possible to increase the production efficiency of the ball-tube mill.

BRIEF DESCRIPTION OF THE DRAWINGS

The invention will now be described in greater detail with reference to a preferred embodiment thereof taken in conjunction with the accompanying drawings, in which.

DESCRIPTION OF THE PREFERRED EMBODIMENT

Figure 1:
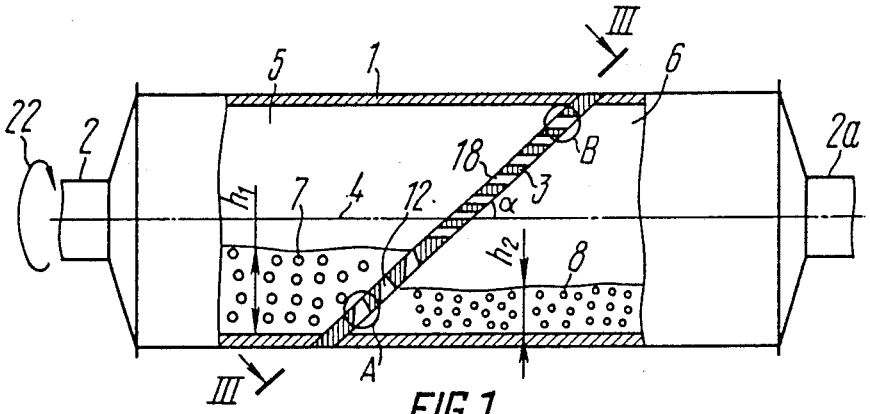
FIG. 1 is a partially cut-away side view of the proposed ball-tube mill.

A ball-tube mill according to the invention comprises a lined drum 1 (FIGS. 1 and 2), hereinafter referred to as drum 1, with trunnions 2 thereof being carried by bearings (not shown) and kinematically linked with a rotation drive (not shown). Secured in the interior of the drum 1 is an inclined wall 3, hereinafter referred to as wall 3, arranged at an angle $\alpha$ to the longitudinal centerline 4 of the drum 1 and having the form of an ellipse. The wall 3 divides the interior of the drum 1 into a coarse grinding chamber 5 and a fine grinding chamber 6. Each such chamber is charged with grinding bodies 7 and 8.

The grinding bodies 7 are of larger diameter than the grinding bodies 8.

Portion 9 (FIG. 3) of contact of the surface of the wall 3 with the grinding bodies 7 occupying the coarse grinding chamber 5 is hypothetically confined by an imaginary line 10 and outer contour 11 of the wall 3.

The portion 9 has through holes 12 for the passage of the material (not shown) being ground through the wall 3. The holes 12 have a length "l" substantially exceeding their width "a".

The holes 12 are so arranged that their elongated sides 13 are parallel with the contour 11 of the wall 3.

Figure 4:
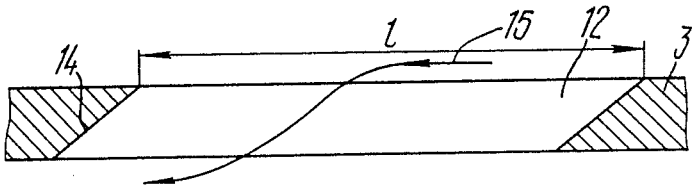
FIG. 4 is an enlarged sectional view taken along the line IV—IV in FIG. 3.

Short sides 14 of the holes 12 are beveled toward the fine grinding chamber 6 in the direction indicated generally by the arrow 15 (FIG. 4), of the travel of the particles of the material being ground through the holes 12 of the wall 3.

In order to ensure free passage of the particles of the material being ground of less than 1 mm in diameter through the holes 12, their length "l" must be at least 25 times the width "a", which corresponds to the rate of rotation of the drum 1 equal to 0.6 of the critical.

At the rate of rotation of the drum 1 equal to 0.8 of the critical the length "l" of each hole 12 must exceed at least 40 times the width "a" thereof.

The walls 3 with the holes 12 disposed only in the portion 9 of contact of the surface of the wall with the grinding bodies 7 inside the coarse grinding chamber 5 are preferably used in ball mills intended for wet grinding.

Figure 5:
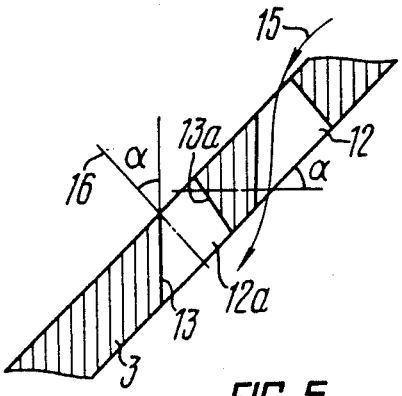
FIG. 5 shows an enlarged section A in FIG. 1.

Through holes 12*a* (FIG.5) flare toward the fine grinding chamber 6 (FIG. 1). Side 13 (FIG. 5) of the hole 12*a* forms with a plane thereof substantially perpendicular to the surface of the wall 3 an angle $\alpha$ equal to the angle $\alpha$ (FIG. 1) of inclination of the wall 3 to the longitudinal centerline 4 of the drum 1, whereas side 13*a* (FIG. 5) is perpendicular to the surface of the wall 3. This cross-section of the hole 12*a* ensures the maximum efficiency of the passage of the particles of the material being ground through the wall 3 from the chamber 5 (FIG. 1) to the chamber 6.

Figure 3:
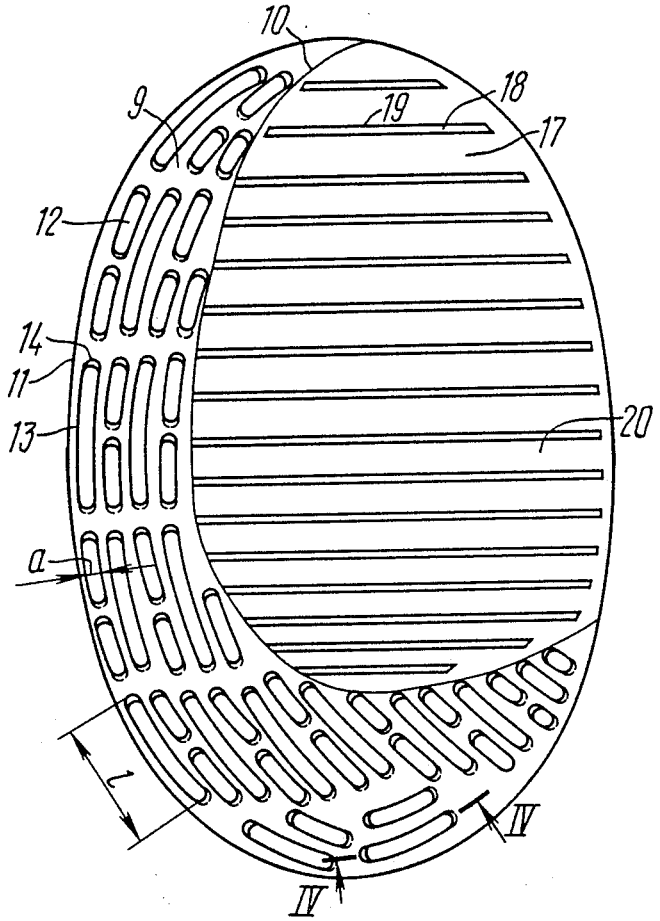
FIG. 3 is an enlarged section taken along the line III—III in FIG. 1.
Figure 6:
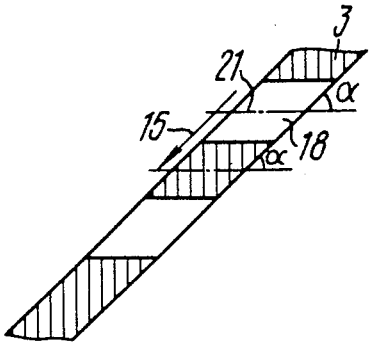
FIG. 6 is an enlarged view of the section B in FIG. 1.

With reference to FIG. 3, in the portion 17 parts of the surface of the wall 3 not in contact with the grinding bodies 7 (FIG. 1) present in the coarse grinding chamber 5 are provided with through holes 18 a longer side 19 (FIG. 3) of which is parallel with a minor axis 20 of the ellipse of the wall 3. Axis 21 (FIG. 6) of symmetry of the holes 18 is parallel with the longitudinal centerline 4 (FIG. 1) of the drum 1.

This arrangement of the holes 18 in the portion 17 of the wall 3 minimizes the hydraulic resistance of the wall 3 during the passage therethrough of the suction air from the chamber 5 to the chamber 6 to result in improved aspiration conditions and more efficient grinding process. In addition, the shape and position of the holes 18 prevent the back-spill of the material being ground from the fine grinding chamber 6 to the coarse grinding chamber 5.

The arrow 22 shows the direction of rotation of the drum 1 (FIG. 1).

The ball-tube mill embodying the present invention operates as follows.

Figure 2:
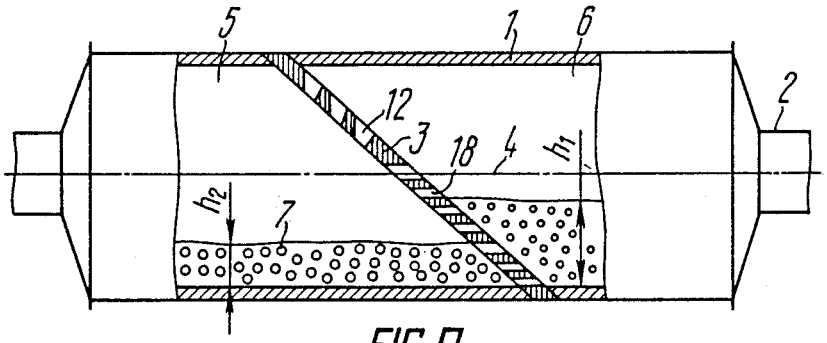
FIG. 2 is a view of the mill in the position of the drum turned 180° from the position shown in FIG. 1.

During rotation of the drum 1 the grinding bodies 7 in the coarse grinding chamber 5 leave a trace at the surface of the wall 3 confined by the line 10 (in one revolution of the drum 1). The level of the grinding bodies 7 changes from the maximum equal to $h_1$ (FIG. 1) to the minimum equal to $h_2$ (FIG. 2). Particles of the material loaded through the charging port provided in the trunnion 2 are caused to move with the mass of the grinding bodies 7 to reach the wall 3. The grinding bodies 7 and the material being ground slide along the surface of the wall 3 in the portion 9 in a direction indicated by the arrow 15, whereby particles of the material present above the holes 12 are delivered to the short side 14 of the hole 12 to pass under the action of the force of gravity through the holes 12 to the fine grinding chamber 6. Then these particles fall into the mass of the grinding bodies 8, where they are finally ground to the end product.

The length "l", width "a", and shape of the holes 12 and 12*a* facilitate the passage of the particles of the material being ground and prevent their jamming by the particles of the broken grinding bodies 7.

The suction air flows from the chamber 5 above the grinding bodies 7 to the chamber 6 to travel further through the discharge hole in the trunnion 2*a*, dust trapping means, and fan (not shown), and be discharged to the outside, whereas the end product enters a bunker (not shown).

In half revolution (180°) in the direction indicated by the arrow 22 the drum 1 assumes a position shown in FIG. 2. Therewith, the level of the grinding bodies 7 in the chamber 5 (due to its extended length in the lower part) becomes minimal, viz., equal to $h_2$, whereas in the chamber 6 the level of the grinding bodies becomes maximal, viz., equal to $h_1$.

Particles of the material travelling through the holes 12 in the wall 3 under the action of the force of gravity fail to pass through the holes 18 from the chamber 6 to the chamber 5, and since the walls of the holes 18 are across the direction 15 (FIG. 6) of the travel path of the particles relative to the wall 3, then the particles of the material rolling down the wall 3 remain in the chamber 6, where they are ground to the final product. The suction air in this position of the drum 1 flows from the chamber 5 through the holes 12 and some of the holes 18 above the grinding bodies 8 to the chamber 6.

This configuration of the holes 18 prevents back-spill of the particles of the material being ground from the chamber 6 to the chamber 5, which results in a more efficient grinding process and a higher output capacity of the mill in general. Also, the provision of the holes 18 in the wall 3 ensures that larger quantities of suction air are passed through the wall 3 from the chamber 5 to the chamber 6, which is favourable for improving the conditions of grinding in the proposed mill.

In the ball-tube mill according to the invention, the direction of the side 13 of the hole 12 coincides with the direction 15 of travel of the particles of the material being ground through the wall from the chamber 5 to the chambe 6, which allows the particles of the material a free passage through the holes 12.

The ball-tube mill according to the invention features minimized hydraulic resistance, has a high throughput capacity and high efficiency in operation.

The invention can find application in the cement making industry, mining, and for other industrial uses, where fine grinding of material is essential.

What is claimed is:

1. A ball-tube mill comprising:

a lined drum having a longitudinal axis;

a coarse grinding chamber inside said lined drum;

a fine grinding chamber inside said lined drum;

coarse and fine grinding bodies respectively occupying said coarse and fine grinding chambers;

an elliptical wall having an outer contour and a minor axis extending transversely to said longitudinal axis, said wall dividing said lined drum into said coarse and fine grinding chambers and being inclined at an angle in relation to said longitudinal axis and defining first and second contacting areas respectively contacting said coarse and fine grinding bodies during rotation of said drum; and through holes having longer and shorter sides for the passage of material, said holes being provided only in said first contacting area of said inclined wall and having a length substantially greater than their width, the longer sides of each holes extending substantially in parallel to the outer contour of said inclined wall.

2. The ball-tube mill as claimed in claim 1, wherein further through holes having longer and shorter sides are provided only in said second contacting area, and the longer side of said further holes are substantially parallel to the minor axis.

3. The ball-tube mill as defined in claim 1, in which the shorter sides of said through holes of said inclined wall are beveled toward said fine grinding chamber.

4. The ball-tube mill as defined in claim 1, in which said through holes flare toward said fine grinding chamber, for which purpose the side of each through hole adjacent the outer contour of said inclined wall forms with a plane perendicular to a plane defined by said inclined wall an angle equal in magnitude to the angle of inclination of this, wall relative to said longitudinal axis.

* * * * *